United States Patent [19]

Yasuoka

[11] Patent Number: 4,936,694

[45] Date of Patent: Jun. 26, 1990

[54] PRINTER HAVING PAPER-INTRODUCING PORTS AT THE FRONT OF THE PRINTER CASING

[75] Inventor: Tadashi Yasuoka, Tokyo, Japan

[73] Assignee: Seikosha Co., Ltd., Japan

[21] Appl. No.: 162,892

[22] Filed: Mar. 2, 1988

[30] Foreign Application Priority Data

Mar. 2, 1987 [JP] Japan ..... 62-30111[U]

[51] Int. Cl.[5] ..... B41J 11/50

[52] U.S. Cl. ..... 400/605; 400/624

[58] Field of Search ..... 400/595, 603, 605, 624, 400/625; 271/9

[56] References Cited

U.S. PATENT DOCUMENTS 4,164,376 8/1979 Yard ..... 400/642
4,391,542 7/1983 Baitz ..... 400/624 X
4,452,543 6/1984 Adkisson et al. ..... 400/605
4,569,586 2/1986 Koyama ..... 271/9 X
4,667,947 5/1987 Costa et al. ..... 400/624 X

FOREIGN PATENT DOCUMENTS 235633 9/1987 European Pat. Off. ..... 400/605

OTHER PUBLICATIONS

IBM Technical Disclosure Bulletin, "Front Loading Multi-Function Document Transport for Printers", vol. 30, No. 6, (Nov. 1987) p. 101-2.

*Primary Examiner*—Edgar S. Burr
*Assistant Examiner*—Moshe I. Cohen
*Attorney, Agent, or Firm*—Bruce L. Adams; Van C. Wilks

[57] ABSTRACT

A printer comprising a port for feeding continuous paper therethrough, a port for feeding cut paper therethrough and a port for feeding paper manually therethrough at the front of a casing of the printer.

6 Claims, 2 Drawing Sheets

PRINTER HAVING PAPER-INTRODUCING PORTS AT THE FRONT OF THE PRINTER CASING

BACKGROUND OF THE INVENTION

This invention relates to a printer and more particularly to the feeding of recording paper.

In a conventional printer, continuous recording paper is stored behind or below the printer and fed out therefrom. A sheet of cut paper is stored behind, above or by a printer and fed out therefrom.

In such printer, it is difficult to supplement recording paper, to ascertain the remaining quantity of paper, and to operate the printer easily.

SUMMARY OF THE INVENTION

It is an object of this invention to facilitate ascertaining the remaining quantity of recording paper and supplementing recording paper, and to improve the operability of the printer.

According to this invention, there is provided a printer comprising a port for feeding continuous paper therethrough, a port for feeding cut paper therethrough and a port for feeding paper manually therethrough at the front of a casing of the printer.

DESCRIPTION OF PREFERRED EMBODIMENT

Figure 1:
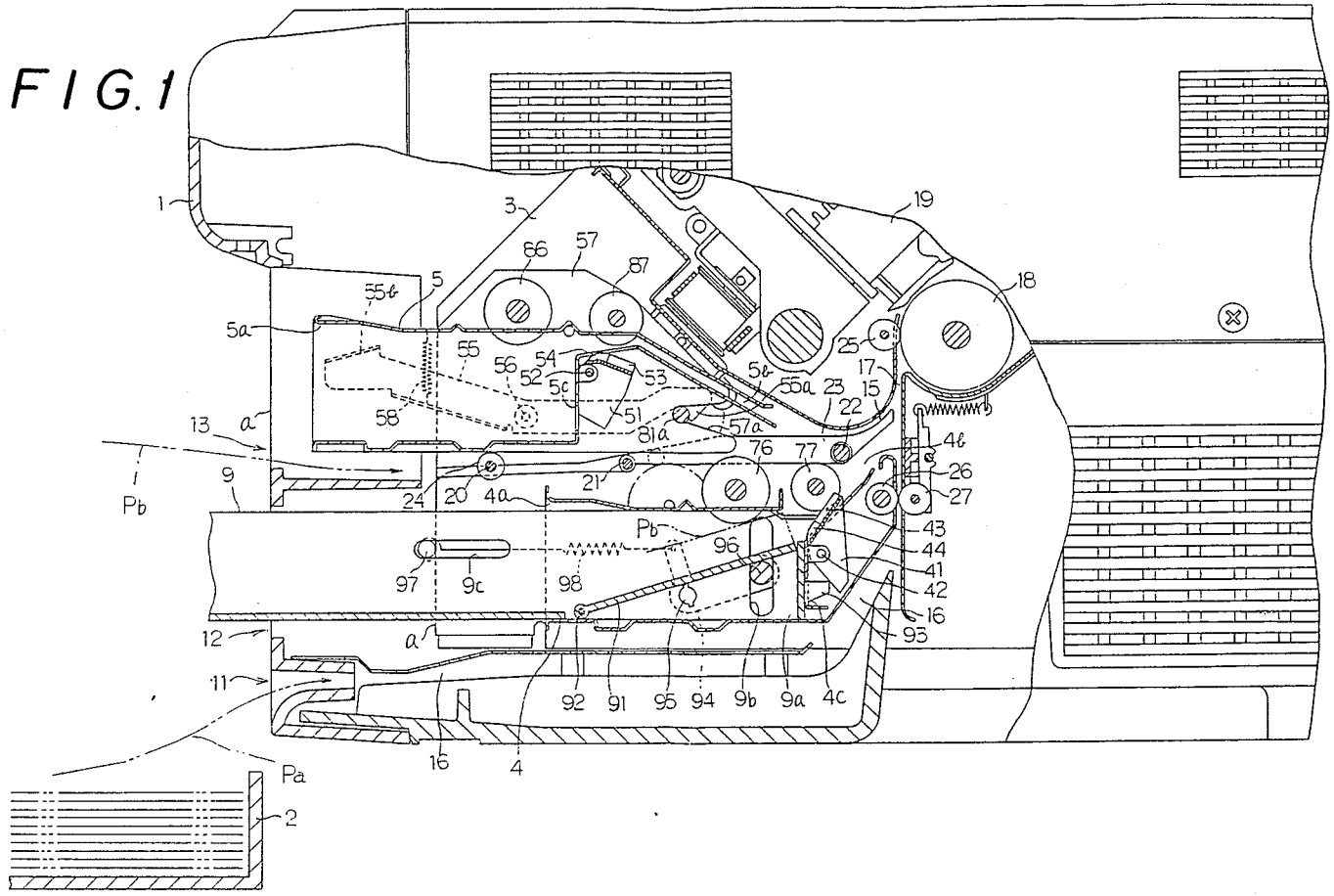
FIG. 1 is a cross-section view of the essential portion of one embodiment of a printer according to this invention.

One embodiment of this invention will now be described with reference to the drawings. FIG. 1 shows the inner surface of left side plate 3 of a pair of side plates within a casing 1 of a printer. The front wall of the casing 1, shown at the left end of FIG. 1, has a lower paper-introducing port 11 for continuous paper Pa fed out from a continuous-paper feed box 2, an intermediate paper-introducing port 12 for cut paper Pb within a cartridge 9, and an upper paper-introducing port 13 into which cut paper Pb is fed manually. The port 13 defines an insertion port of an accommodating casing for a second cartridge when a second cartridge is used. FIG. 1 shows the state in which an accommodating casing 5 for the second cartridge is mounted. An upper and a lower accommodating casings 4 and 5 on each of which a cut paper cartridge 9 is mountable are provided at the depths of ports 12 and 13, respectively, of the casing 1. The openings 4*a* and 5*a* of the casings 4 and 5 oppose ports 12 and 13, respectively. The casing 4 is fixed to the side plate 3 while casing 5 is mounted removably on the side plate 3 by removable mounting means to be descirbed late in more detail.

Figure 2:
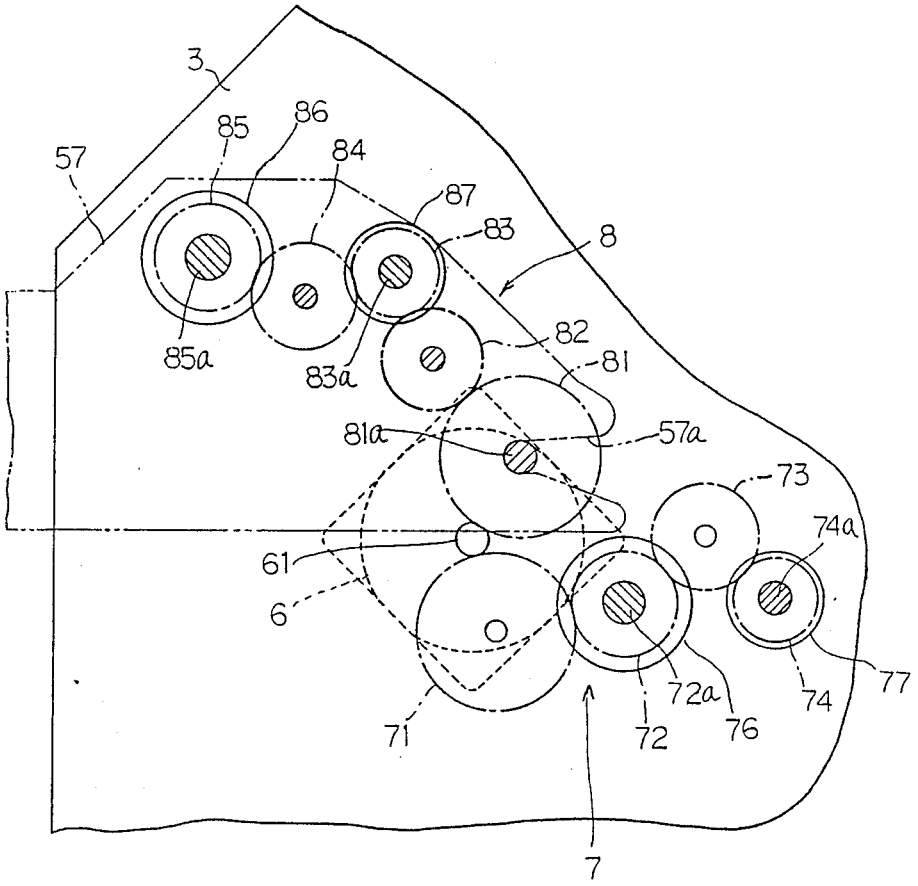
FIG. 2 is a schematic enlarged view of a drive gear train used in the embodiment.

FIG. 2 shows a driving gear wheel train for the paper feed units. A drive motor 6 is a reversible motor used exclusively for feeding cut paper. Two series drive gear wheel trains 7 and 8 are disposed in conjunction with drive motor 6. Pinion 61 of the motor 6, and gear wheels 71, 72, 73 and 74 of the drive wheel train 7 mesh one with the other, in this order. The shafts 72*a* and 74*a* of gear wheels 72 and 74 have a feed roller 76 which comprises cut paper feed means and a pickup roller 77, respectively, mounted thereto. A one-way clutch is disposed between gear wheel 72 and shaft 72*a* an another one-way clutch is disposed between gear wheel 74 and shaft 74*a*. Pinion 61 of the motor 6, and gear wheels 81, 82, 83, 84, 85 of the other drive wheel train 8 mesh, one with the other, in this order. The shafts 85*a* and 83*a* of gear wheels 85 and 83 have a feed roller 86 which comprises cut paper feed means and a pickup roller 87, respectively, fixed thereto. A one-way clutch is disposed between gear wheel 85 and shaft 85*a* and another one-way clutch is disposed between gear wheel 83 and shaft 83*a*.

Thus, when motor 6 starts and pinion 61 rotates counterclockwise, torque is transmitted to the drive wheel trains 7 and 8. In this situation, the one-way clutch disposed between gear wheel 72 and shaft 72*a* and the one-way clutch disposed between gear wheel 74 and shaft 74*a* are engaged so that rotation is transmitted to feed roller 76 and pickup roller 77. In this direction of rotation, the one-way clutch disposed between gear wheel 85 and its shaft and the one-way clutch disposed between gear wheel 83 and its shaft are disengaged, so that rotation is transmitted to feed roller 86 and pickup roller 87. Therefore, when pinion 61 is rotated counterclockwise, roller 76 and 77 which are paper feed means are rotated, cut paper Pb in the cartridge 9 in the casing 4 is fed into passageway 4*b*.

When pinion 61 is reversely rotated in the clockwise direction, this rotation is transmitted to drive wheel trains 7 and 8. In this direction of rotation, the one-way clutch disposed between gear wheel 85 and its shaft and the one-way clutch disposed between gear wheel 83 and its shafts are engaged so that rotation is transmitted to paper feed roller 86 and pickup roller 87. In this direction of rotation, the one-way clutch disposed between gear wheel 72 and its shaft and the one-way clutch disposed between gear wheel 74 and its shaft are disengaged so that no rotation is transmitted to feed roller 76 and pickup roller 77. Therefore, when pinion 61 rotates clockwise, roller 86 and 87 which are paper feed means are rotated so that cut paper Pb in the cartridge 9 in the accommodating case 5 is fed into passageway 5*b*.

As described above, the accommodating case 5 is mounted removably, and its structure will now be described. The case 5 takes the form of a box having a front openings 5*a* and both sides of the case 5 are fixed to corresponding support plates 57 to thereby constitute a unit. Gears 82–85 are supported on the outer surfaces of support plates 57 while rollers 86 and 87 are positioned on the inner surface of support plate 57. The shaft 81*a* of gear wheel 81 is engaged in a recess 57*a* formed at the rear end of support plate 57 to thereby restrict the entrance of support plate 57. Case 5 has a paper feed passageway 5*b* on the side of the rear surface of case 5. A classifying lever 51 is mounted swingably by a shaft 52 on the back of the case 5 so as to contact pickup roller 87. A resilient member 53 having a large coefficient of friction and a plastic guide 51*a* are provided on the upper surface of classifying lever 51 at positions not facing pickup roller 87. A lock lever 55 is mounted swingably on shaft 56 on the outer surface of support plate 57. A hook 55*a* is provided at the rear end of lock lever 55 and is engageable with shaft 81*a*. An operation portion 55*b* is provided at the front end of lock lever 55. When case 5 is to be removed together with support plate 57, the operation portion 55*b* is depressed so that hook 55*a* is disengaged from shaft 81*a* so as to enable the case 5 to be withdrawn. A spring 58 is engaged with lock lever 55 such that hook 55*a* is normally engaged with shaft 81*a* resiliently.

A classifying lever lever 41 substantially similar to the above classifying lever 51 is also provided swingably on the rear end surface of the case 4. A resilient member 43 and a guide 41*a* similar to the above corresponding ones are provided on the upper surface of classifying lever 41.

When the accommodating case 5 is removed, paper can be manually fed to the pasageway 15. For this purpose, the shafts 20, 21 and 22 are fixedly supported within the port 13 and cross with a plurality of guide rails 23 for manually fed paper to thereby guide paper to be fed manually into the passageway 15. Roller 24 is provided on shaft 20 to facilitate insertion of the case 5 and to support same.

The cut paper cartridge 9 will now be described. The cartridge is usable in common with the accommodating cases 4 and 5. The cartridge 9 takes the form of a box open at its upper end and has a hole 9*a* at its rear end bottom. A hopper plate 91 for closing the hole 9*a* is swingably supported swingable by shaft 92 at its front end and slidable back and forth. A protrusion 93 is provided at the back of cartridge 9 to swing the classifying levers 41 and 51 and extends backwardly from windows 4*c* and 5*c* of cases 4 and 5 to swing levers 41 and 51. Cartridge 9 has a vertical guide slot 9*b* at its rear side end and a horizontal guide slot 9*c* at its front side end. A push up lever 94 is mounted swingably on shaft 95 on the outer surface of cartridge 9. A guide pin 96 is provided at the rear end of push up lever 94 such that it is slidable vertically within the guide slot 9*b* below the hopper plate 91. A guide pin 97 is provided slidable back and forth in and restrained to undergo sliding movement within the guide hole 9*c*. A spring 98 is engaged between the front end of push up lever 94 and guide pin 97. Therefore, a spring force is exerted on push up lever 94 so as to move guide pin 96 upwardly, so that guide pin 96 is pushed against the lower surface of hopper plate 91.

Cartridge 9 has such a structure that guide pin 97 is moved to the rear end of guide slot 9*c* when the cartridge 9 is drawn out and the tension of spring 98 is reduced. Therefore, when cut paper Pb is inserted through the upper opening into cartridge 9, the hopper plate 91 is lowered by the weight of paper Pb to thereby accommodate the paper. When cartridge 9 is inserted in the case 4 or 5, guide pin 97 is prevented from its further entrance by the engaging portion a provided on the side plate 3 or casing 1. Further insertion of cartridge 9 to a predetermined position causes spring 98 to be extended to thereby increase its tension. Therefore, the push up lever 94 is swung, guide pin 96 is moved upwardly, hopper plate 91 is swung, so that cut paper Pb is pushed against feed rollers 76 and 86 resiliently.

The cut paper Pb fed out from the accommodating case 4 within the feed port 12 and having passed through a passageway 17 into which the cut paper passageway 4*b*, the case passageway 5*b* and the passageway 15 for paper Pb inserted through manually feed port 13 merge is pushed against platen 18 by pinch roller 25 and guided by the rotation of the platen into the printing section between the platen 18 and printing head 19. Continuous paper Pa fed out from paper feed box 2 is inserted through feed port 11, passed along continuous paper passageway 16, fed between drive roller 26 and pinch roller 27, fed into passageway 17 by the rotation of drive roller 26 and then guided to the printing section in the manner similar to that as mentioned above.

As described above in detail, in this invention, the continuous paper feed port, automatic feed port for cut paper and manual feed port are disposed separately on the front wall of the casing, so that it is very easy to ascertain the remaining quantity of recording paper and to supplement recording paper at an appropriate time. It is also very easy to mount and remove the cartridge.

What is claimed is:

1. In a printer having a front casing portion having a front wall and a rear casing portion and a printing mechanism for printing on paper: first paper feeding means including a first paper-introducing port located at the front wall of the front casing portion for exclusively feeding continuous paper to the printing mechanism; second paper feeding means including a second paper-introducing port located at the front wall of the front casing portion in spaced relation from the first paper-introducing port for removably receiving therein a paper cartridge containing cut sheet paper for exclusively feeding cut sheet paper from the cartridge to the printing mechanism; and third paper feeding means including a third paper-introducting port located at the front wall of the front casing portion in spaced relation from the first and second paper-introducing ports for enabling manual feeding of paper to the printing mechanism, for third paper feeding means including means for removably receiving in the third paper-introducing port a paper cartridge containing cut sheet paper to enable feed of cut sheet paper from the cartridge to the printing mechanism when the cartridge is removably received in the third paper-introducing port and to otherwise enable manual feeding of paper to the printing mechanism when the cartridge is removed from the third paper-introducing port.

2. A printer according to claim 1; wherein the first, second and third paper-introducing ports are vertically spaced from one another at the front wall of the front casing portion.

3. A printer according to claim 2; wherein the first paper-introducing port is the lowermost one of the first, second and third paper-introducing ports.

4. A printer according to claim 3; wherein the third paper-introducing port is the uppermost one of the first, second and third paper-introducing ports.

5. A printer according to claim 2; wherein the third paper-introducing port is the uppermost one of the first, second and third paper-introducing ports.

6. A printer according to claim 1, wherein the means for removably receiving the paper cartridge comprises a casing removably insertable into the third paper-introducing port and configured to removably receive therein the cartridge, the casing having a paper feed passageway at the rear end thereof for feeding cut sheet paper from the cartridge to the printing mechanism.

* * * * *